US010513120B1

(12) United States Patent
Ou

(10) Patent No.: US 10,513,120 B1
(45) Date of Patent: Dec. 24, 2019

(54) INK CARTRIDGE CLEAN DEVICE

(71) Applicant: TECO IMAGE SYSTEMS CO., LTD., Taipei (TW)

(72) Inventor: Teng-Yuan Ou, Taipei (TW)

(73) Assignee: TECO IMAGE SYSTEMS CO., LTD., Taipei (TW)

( * ) Notice: Subject to any disclaimer, the term of this patent is extended or adjusted under 35 U.S.C. 154(b) by 0 days.

(21) Appl. No.: 16/178,312

(22) Filed: Nov. 1, 2018

(30) Foreign Application Priority Data

Aug. 8, 2018 (TW) ..... 107127694 A

(51) Int. Cl.

| | |
|---|---|
| ***B41J 2/165*** | (2006.01) |
| ***B08B 1/00*** | (2006.01) |
| ***B08B 17/02*** | (2006.01) |
| ***B41J 2/20*** | (2006.01) |

(52) U.S. Cl.
CPC ..... *B41J 2/16505* (2013.01); *B08B 1/005* (2013.01); *B08B 17/025* (2013.01); *B41J 2/16541* (2013.01); *B41J 2/16544* (2013.01); *B41J 2/16547* (2013.01); *B41J 2/20* (2013.01); *B41J 2002/16576* (2013.01)

(58) Field of Classification Search
CPC ..... B41J 2/16505; B41J 2/16547; B41J 2/16541; B41J 2/16544; B41J 2002/16576; B41J 2/20; B08B 1/007; B08B 1/005; B08B 17/025
See application file for complete search history.

(56) References Cited

U.S. PATENT DOCUMENTS

2004/0223029 A1* 11/2004 Nishino ..... B41J 2/16526 347/33
2012/0026244 A1* 2/2012 Inoue ..... B41J 2/16585 347/33
2013/0025391 A1* 1/2013 Magnusson ..... B41J 11/42 74/409
2013/0050335 A1* 2/2013 Tanaka ..... B41J 2/16511 347/32

FOREIGN PATENT DOCUMENTS

JP 2007276304 * 10/2007 ..... B41J 2/165
JP 2007276304 A 10/2007
TW 305275 U 5/1997

* cited by examiner

*Primary Examiner* — Henok D Legesse
(74) *Attorney, Agent, or Firm* — Kirton McConkie; Evan R. Witt

(57) ABSTRACT

An ink cartridge clean device including a housing, a work platform, at least one ink stack and at least one ink absorption pad clean element. The housing has a first sidewall and a second sidewall opposite to each other, and an accommodation groove is defined by the housing. The work platform is disposed in the accommodation groove and has two lateral surfaces opposite to each other, and each lateral surface has at least one stopper. The ink stack is disposed on the work platform, and has an ink absorption pad. The ink absorption pad clean element is rotatably connected with the first sidewall and the second sidewall. When the work platform is adjusted from a first position to a second position, the ink absorption pad clean element is rotated, so that the corresponding ink absorption pad is cleaned, thereby preventing the residual ink from contaminating or blocking the ink cartridge.

10 Claims, 5 Drawing Sheets

INK CARTRIDGE CLEAN DEVICE

CROSS-REFERENCE TO RELATED APPLICATION

This application claims priority from Taiwan Patent Application No. TW 107127694, filed on Aug. 8, 2018, the entire contents of which are incorporated herein by reference for all purposes.

FIELD OF THE INVENTION

The present invention relates to an ink cartridge clean device, and more particularly to an ink cartridge clean device having an ink absorption pad clean element.

BACKGROUND OF THE INVENTION

Recently, inkjet printers are widely used as printing equipment due to their excellent printing quality. In order to maintain the printing quality of inkjet printers, inkjet printers are often provided with ink cartridge maintenance devices for cleaning and maintaining the nozzles of the ink cartridges to avoid ink contamination or blockage.

Generally, in the ink cartridge maintenance devices, the ink stacks are the structural elements most frequently contacted with the ink cartridges, and the nozzles of the ink cartridges are connected with the ink absorption pumps through the ink stacks to achieve vacuum ink extraction and moisturizing effects. Since the operation and contact of the ink stacks and the ink cartridges are relatively frequent, there is a considerable degree of requirement to the cleanliness of their contact surfaces.

The common pollution sources of the contact surfaces of the ink stacks include the siphon phenomenon caused by the separation of the ink stacks and the ink cartridges at the end of the ink absorption or the pollution generated while flash spraying. The nozzles of the ink cartridges may be directly affected by those pollution sources when the next time that the ink cartridges are contacted with the ink stacks, thereby causing contamination, color mixing or clogging of the ink cartridges and paper contamination, so that the printing quality is decreased.

Therefore, there is a need of providing an ink cartridge clean device to solve the drawbacks in prior arts, solve the pollution problems of the contact surface of the ink stack effectively, prevent the residual ink from contaminating or blocking the ink cartridge, and achieve the advantage of enhancing the printing quality.

SUMMARY OF THE INVENTION

It is an object of the present invention to provide an ink cartridge clean device in order to solve the drawbacks of prior art.

The present invention provides an ink cartridge clean device. By adjusting the work platform to rise or descend, the ink absorption pad clean element is contacted with the ink absorption pad or rotated to contact with the housing, thereby cleaning the corresponding ink absorption pad, so that the residual ink is prevented from contaminating or blocking the ink cartridge, and the printing quality is enhance.

The present invention also provides an ink cartridge clean device. Through applying pressure to the curved rods of the ink absorption pad clean element by the stoppers or making the stoppers raise relative to the curved rods, the main body of the ink absorption pad clean element is contacted with the ink absorption pad or rotated by gravity to contact with the housing, so that the ink absorption pad is cleaned.

The present invention also provides an ink cartridge clean device. Through disposing the scraper on the work platform, when the work platform is adjusted from the first position to the second position, the ink absorption pad clean element is rotated, and the ink absorption cotton of the ink absorption pad clean element is cleaned by the scraper. Therefore, the residual ink on the ink absorption cotton is scraped, so that the ink absorption pad can be more effectively cleaned by the ink absorption cotton.

In accordance with an aspect of the present invention, there is provided an ink cartridge clean device. The ink cartridge clean device is applied to clean at least one ink cartridge, and the ink cartridge clean device includes a housing, a work platform, at least one ink stack and at least one ink absorption pad clean element. The housing has a first sidewall and a second sidewall opposite to each other, and an accommodation groove is defined by the housing. The work platform is disposed in the accommodation groove and has two lateral surfaces opposite to each other. One of the lateral surfaces is disposed adjacent to the first sidewall, the other lateral surface is disposed adjacent to the second sidewall, and each of the lateral surfaces has at least one stopper. The ink stack is disposed on the work platform, and the ink stack corresponds one-to-one to the ink cartridge and has an ink absorption pad. The ink absorption pad clean element is rotatably connected with the first sidewall and the second sidewall. When the work platform is adjusted to a first position, the stoppers make the ink absorption pad clean element contact with the corresponding ink absorption pad. When the work platform is adjusted from the first position to a second position, the ink absorption pad clean element is rotated to contact with the housing, so that the ink absorption pad is cleaned.

In accordance with another aspect of the present invention, there is provided an ink cartridge clean device. The ink cartridge clean device is applied to clean two ink cartridges, and the ink cartridge clean device includes a housing, a work platform, two ink stacks and two ink absorption pad clean elements. The housing has a first sidewall, a second sidewall, a third sidewall and a forth sidewall. The first sidewall is opposite to the second sidewall, the first sidewall is adjacent to the third sidewall and the forth sidewall, and an accommodation groove is defined by the housing. The work platform is disposed in the accommodation groove and has two lateral surfaces opposite to each other. One of the lateral surfaces is disposed adjacent to the first sidewall, the other lateral surface is disposed adjacent to the second sidewall, and each of the lateral surfaces has two stoppers. The ink stacks are disposed on the work platform, and the ink stacks correspond one-to-one to the ink cartridges. Each of the ink stacks has an ink absorption pad, and each of the ink absorption pad clean elements is rotatably connected with the first sidewall and the second sidewall. When the work platform is adjusted to a first position, the stoppers make each of the ink absorption pad clean elements contact with the corresponding ink absorption pad. When the work platform is adjusted from the first position to a second position, one of the ink absorption pad clean elements is rotated to contact with the third sidewall, and the other ink absorption pad clean element is rotated to contact with the forth sidewall, so that the ink absorption pads are cleaned.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
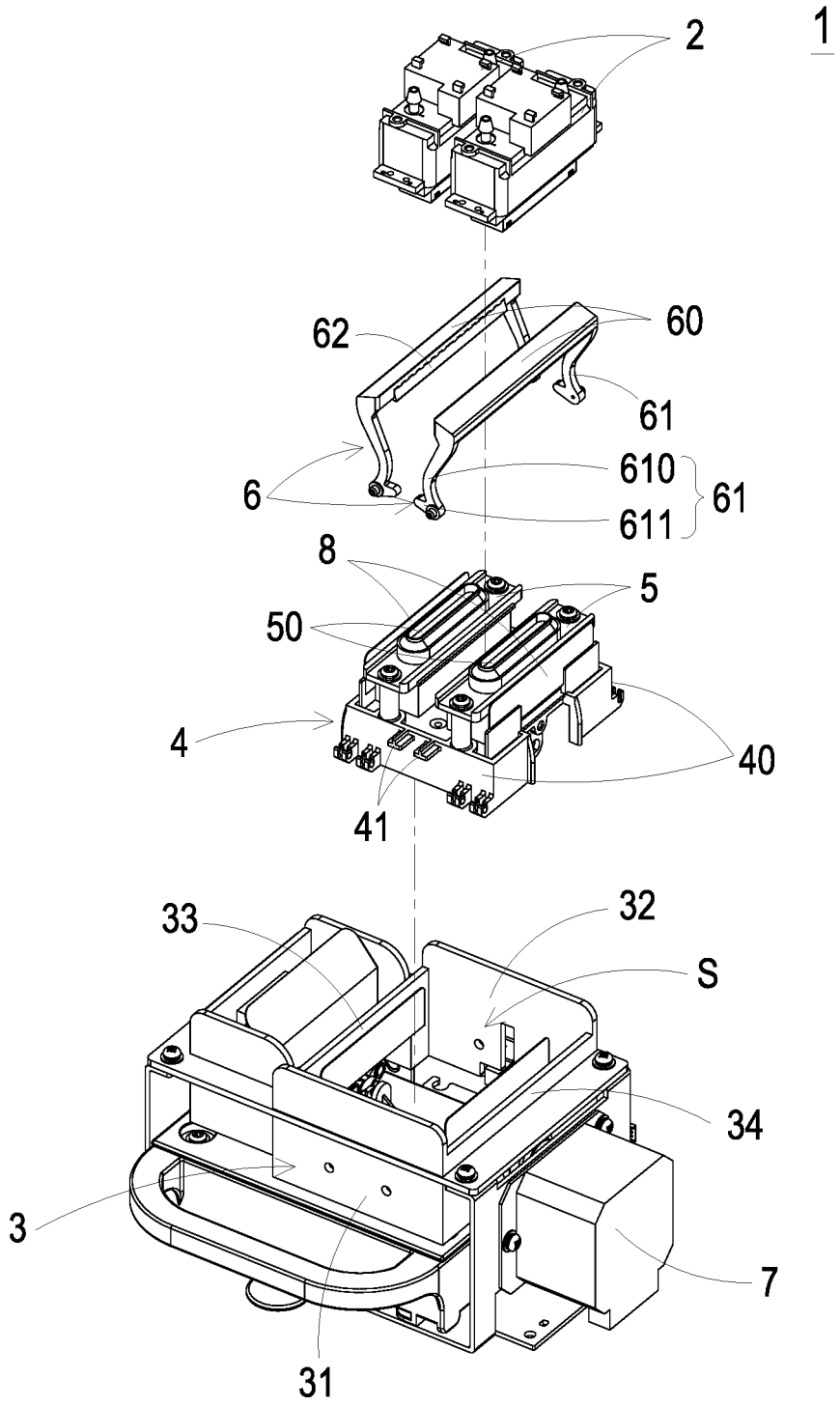
FIG. 1 schematically illustrates the exploded structure of an ink cartridge clean device and ink cartridges according to an embodiment of the present invention.
Figure 2A:
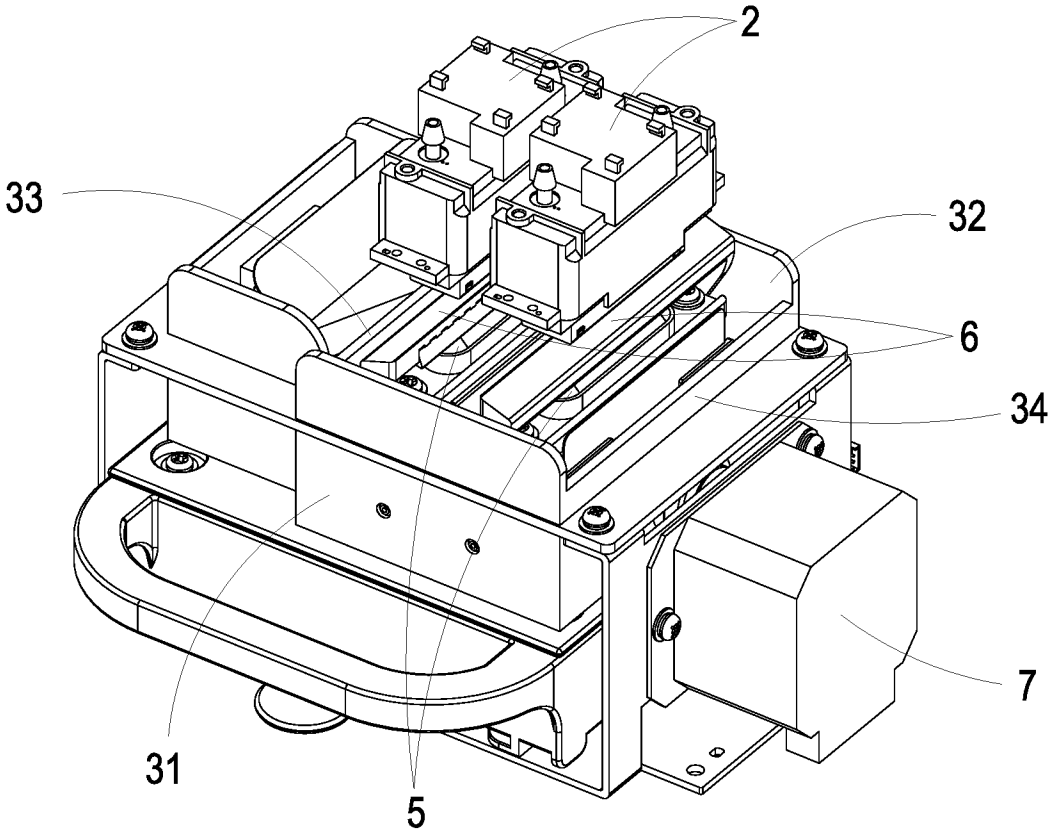
FIG. 2A schematically illustrates the structure of an ink cartridge clean device at a first position according to an embodiment of the present invention.
Figure 2B:
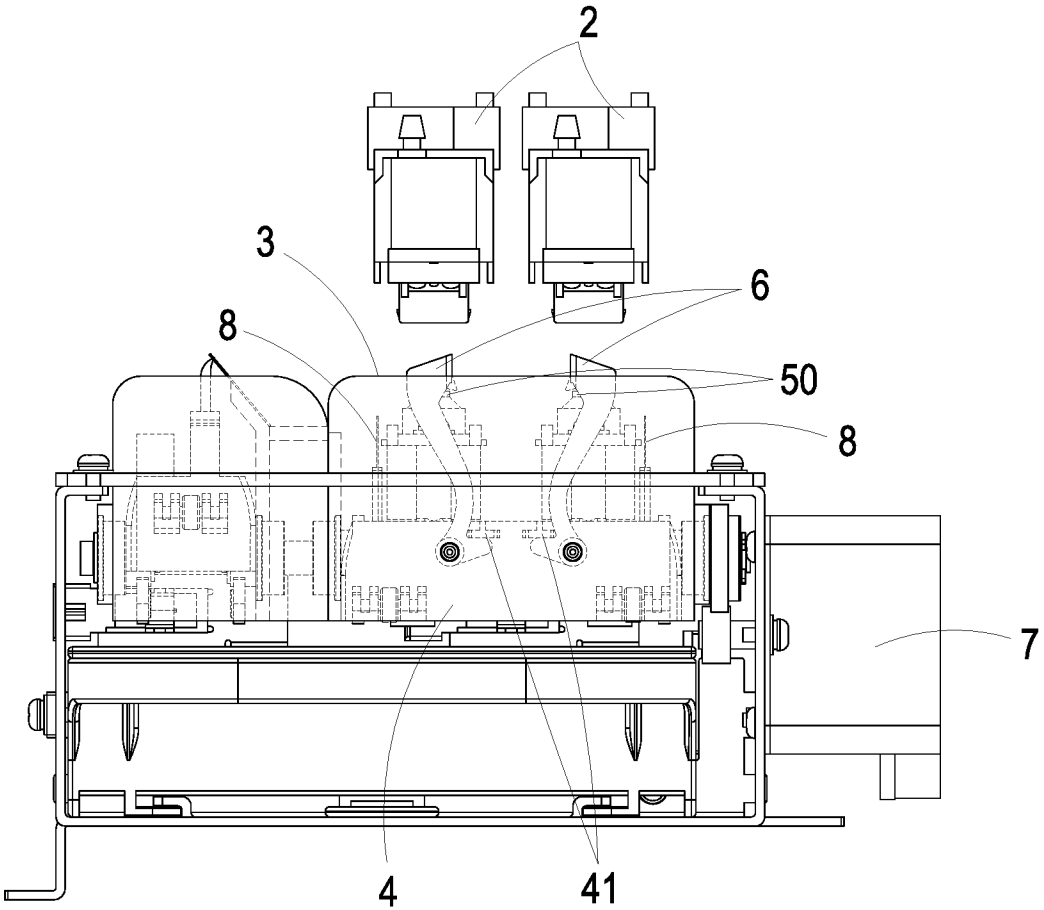
FIG. 2B schematically illustrates the side view of an ink cartridge clean device at a first position according to an embodiment of the present invention.
Figure 3A:
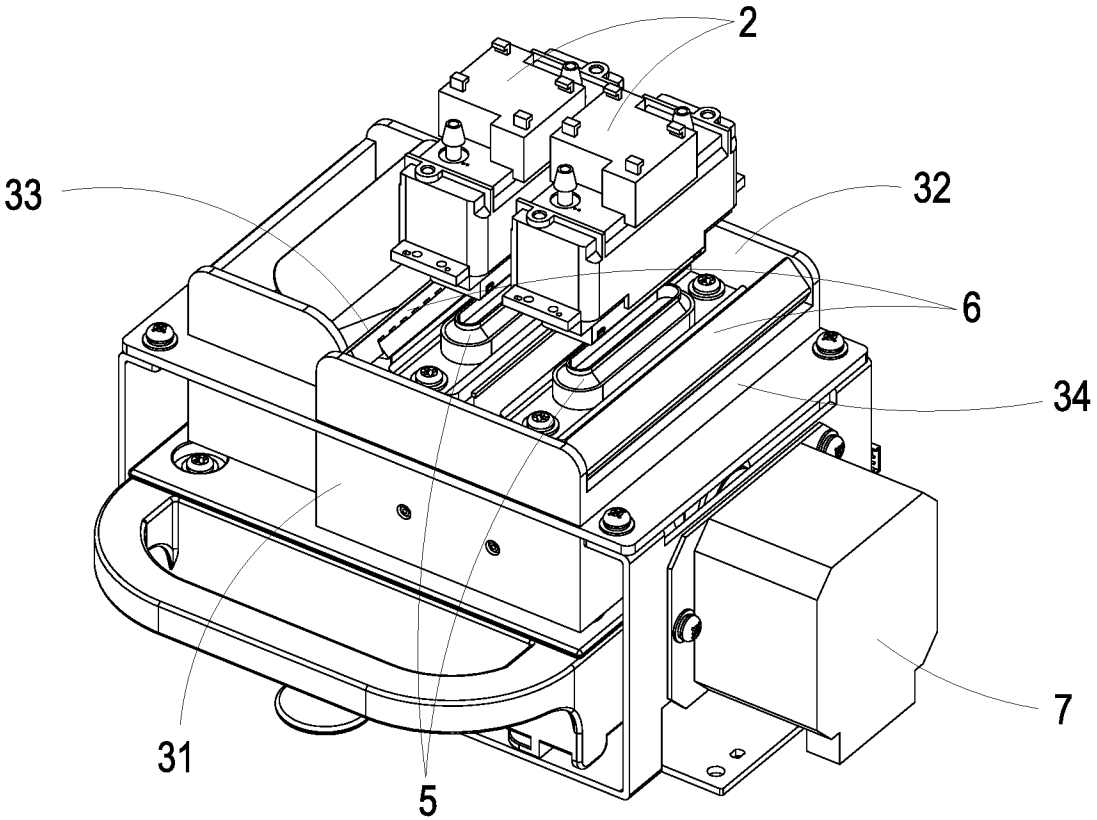
FIG. 3A schematically illustrates the structure of an ink cartridge clean device at a second position according to an embodiment of the present invention.
Figure 3B:
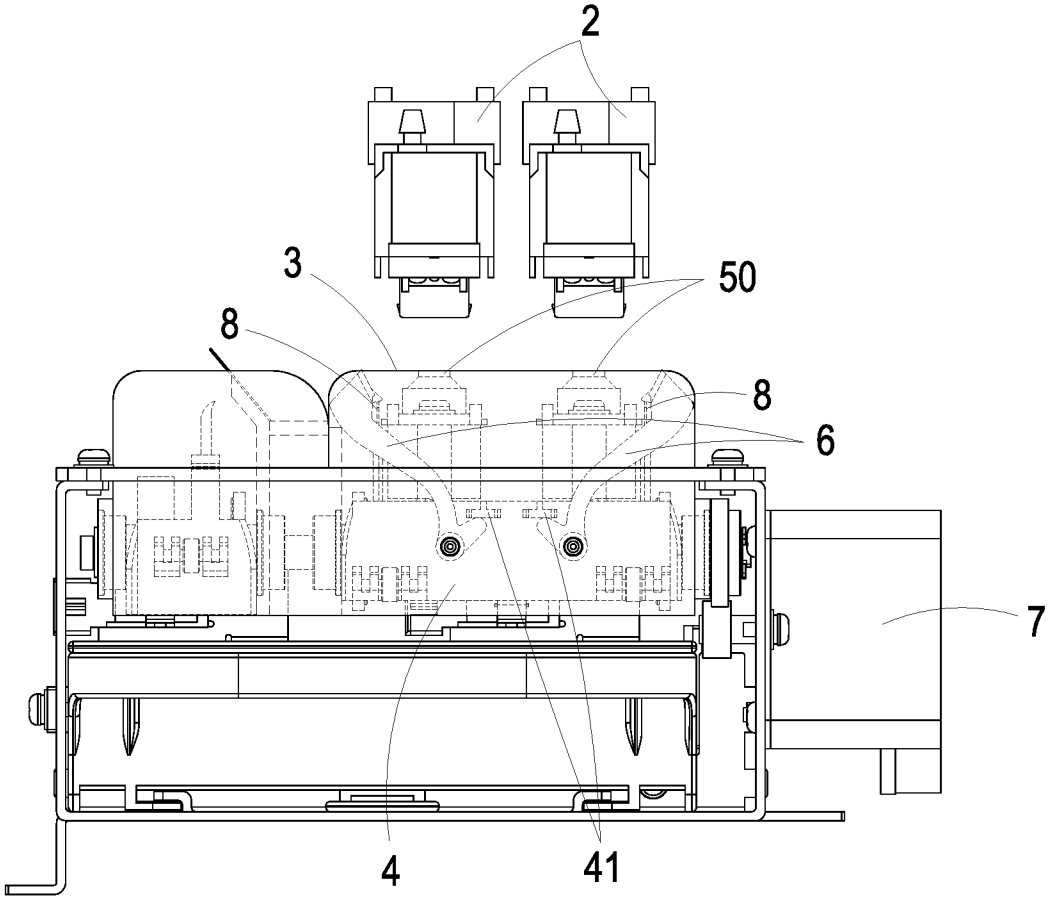
FIG. 3B schematically illustrates the side view of an ink cartridge clean device at a second position according to an embodiment of the present invention.

Please refer to FIG. 1, FIG. 2A, FIG. 2B, FIG. 3A and FIG. 3B. FIG. 1 schematically illustrates the exploded structure of an ink cartridge clean device and ink cartridges according to an embodiment of the present invention. FIG. 2A schematically illustrates the structure of an ink cartridge clean device at a first position according to an embodiment of the present invention. FIG. 2B schematically illustrates the side view of an ink cartridge clean device at a first position according to an embodiment of the present invention. FIG. 3A schematically illustrates the structure of an ink cartridge clean device at a second position according to an embodiment of the present invention. FIG. 3B schematically illustrates the side view of an ink cartridge clean device at a second position according to an embodiment of the present invention. As shown in FIG. 1, FIG. 2A, FIG. 2B, FIG. 3A and FIG. 3B, the ink cartridge clean device 1 of the present invention is applied to clean at least one ink cartridge 2, and the ink cartridge clean device 1 includes a housing 3, a work platform 4, at least one ink stack 5 and at least one ink absorption pad clean element 6.

The housing 3 has a first sidewall 31 and a second sidewall 32 opposite to each other, and an accommodation groove S is defined by the housing 3. The work platform 4 is disposed in the accommodation groove S, and the work platform 4 has two lateral surfaces 40 opposite to each other. One of the lateral surfaces 40 is disposed adjacent to the first sidewall 31, and the other lateral surface 40 is disposed adjacent to the second sidewall 32. Each of the lateral surfaces 40 has at least one stopper 41, and the stoppers 41 can be, for example but not limited to, projections extended from the surface of the first sidewall 31 or the second sidewall 32.

The ink stack 5 is disposed on the work platform 4, and the ink stack 5 corresponds one-to-one to the ink cartridge 2. Each ink stack 5 has an ink absorption pad 50, and the ink absorption pad 50 is used for connecting with the nozzle of the ink cartridge 2 to absorb ink, clean and moisturize the nozzle of the ink cartridge 2. The ink absorption pad clean element 6 can be, for example but not limited to, disposed one-to-one corresponding to the ink stack 5, and each ink absorption pad clean element 6 is rotatably connected with the first sidewall 31 and the second sidewall 32 of the housing 3. For example, a rotating shaft is penetrated through the ink absorption pad clean element 6 and the first sidewall 31, and another rotating shaft is penetrated through the ink absorption pad clean element 6 and the second sidewall 32, so that the connection of the ink absorption pad clean element 6 and the first sidewall 31 and the second sidewall 32 can be achieved, but not limited herein.

When the work platform 4 is adjusted to descend to a first position, as shown in FIG. 2A and FIG. 2B, the stoppers apply pressure to make the ink absorption pad clean element 6 contact with the corresponding ink absorption pad 50. When the work platform 4 is adjusted to rise from the first position to a second position, as shown in FIG. 3A and FIG. 3B, the ink absorption pad clean element 6 is rotated by gravity to contact with the housing 3, so that the corresponding ink absorption pad 50 is cleaned through the rotating path. In some embodiments, the ink cartridge clean device 1 further includes a transmission mechanism 7. The transmission mechanism 7 is connected with the work platform 4, thereby adjusting the work platform 4 to descend to the first position or rise to the second position, but not limited herein.

In some embodiments, each ink absorption pad clean element 6 has a main body 60 and two curved rods 61, and the curved rods 61 are respectively extended from two ends of the main body 60. One of the curved rods 61 is rotatably connected with the first sidewall 31, and the other curved rod 61 is rotatably connected with the second sidewall 32. That is to say, the main body 60 is extended across the two ends of the ink stack 5, and the two curved rods 61 extended from the main body 60 are respectively connected with the first side wall 31 and the second side wall 32.

When the work platform 4 is adjusted to the first position, as shown in FIG. 2A and FIG. 2B, each of the stoppers 41 applies pressure to one of the curved rods 61, so that the main body 60 of the ink absorption pad clean element 6 is contacted with the corresponding ink absorption pad 50. When the work platform 4 is adjusted from the first position to the second position, each of the stoppers 41 is raised relative to the curved rod 61, and the stoppers 41 no longer apply pressure to the curved rods 61, so that the absorption pad clean element 6 is rotated by gravity to make the main body 60 contact with the housing 3. That is to say, the ink absorption pad clean element 6 is naturally swayed down by gravity until the main body 60 is blocked and stopped by the housing 3, so that the ink absorption pad 50 is cleaned through the rotating path.

In some embodiments, each of the curved rods 61 has an extending part 610 and a curving part 611. The extending part 610 is extended from the main body 60 of the ink absorption pad clean element 6, the curving part 611 is connected with the extending part 610, and the curving part 611 is connected with the first sidewall 31 or the second sidewall 32. When the work platform 4 is adjusted to the first position, each of the stoppers 41 applies pressure to the curving part 611 of one of the curved rods 61. When the work platform 4 is adjusted from the first position to the second position, each of the stoppers 41 is raised relative to the curving part 611 of the curved rod 61, so that the stoppers 41 no longer apply pressure to the curving parts 611. In some embodiments, the stoppers are T-shaped stoppers to apply pressure to the curving parts 611 more stably, but not limited herein.

In other words, in the ink cartridge clean device of the present invention, by adjusting the work platform to rise or descend, the ink absorption pad clean element is contacted with the ink absorption pad or rotated to contact with the housing, thereby cleaning the corresponding ink absorption pad, so that the residual ink is prevented from contaminating or blocking the ink cartridge, and the printing quality is enhance. Furthermore, through applying pressure to the curved rods of the ink absorption pad clean element by the stoppers or making the stoppers raise relative to the curved rods, the main body of the ink absorption pad clean element is contacted with the ink absorption pad or rotated by gravity to contact with the housing, so that the ink absorption pad is cleaned.

In some embodiments, the main body 60 of each ink absorption pad clean element 6 further has an ink absorption cotton 62, so that when the main body 60 is in contact with the ink absorption pad 50, the residual ink remaining on the ink absorption pad 50 is absorbed through the ink absorption cotton 62, thereby cleaning the ink absorption pad 50 of the ink stack 5. In some embodiments, the ink cartridge clean device 1 of the present invention further includes at least one scraper 8. Each scraper 8 is disposed on the work platform 4, and when the work platform 4 is adjusted from the first position to the second position, the corresponding ink absorption cotton 62 is cleaned by each scraper 8. That is to say, on the rotating path that the ink absorption pad clean element 6 is rotated by gravity to contact with the housing 3, the residual ink on the absorption cotton 62 is scraped by the scraper 8.

In other words, in the ink cartridge clean device of the present invention, through disposing the scraper on the work platform, when the work platform is adjusted from the first position to the second position, the ink absorption pad clean element is rotated, and the ink absorption cotton of the ink absorption pad clean element is cleaned by the scraper. Therefore, the residual ink on the ink absorption cotton is scraped, so that the ink absorption pad can be more effectively cleaned by the ink absorption cotton.

In some embodiments, the ink cartridge clean device 1 is applied to clean two ink cartridges 2, and the ink cartridge clean device 1 includes a housing 3, a work platform 4, two ink stacks 5 and two ink absorption pad clean elements 6. The housing 3 has a first sidewall 31, a second sidewall 32, a third sidewall 33 and a forth sidewall 34, among which the first sidewall 31 is opposite to the second sidewall 32, the first sidewall 31 is adjacent to the third sidewall 33 and the forth sidewall 34, and an accommodation groove S is defined by the housing 3.

The work platform 4 is disposed in the accommodation groove S, and the work platform 4 has two lateral surfaces 40 opposite to each other. One of the lateral surfaces 40 is disposed adjacent to the first sidewall 31, and the other lateral surface 40 is disposed adjacent to the second sidewall 32. Each of the lateral surfaces 40 has two stoppers 41, and the stoppers 41 can be T-shaped stoppers and are line-symmetrical to each other on each lateral surface 40, but not limited herein.

The two ink stacks 5 are disposed on the work platform 4, and correspond one-to-one to the two ink cartridges 2, and each of the ink stacks 5 has an ink absorption pad 50. The two ink absorption pad clean elements 6 correspond one-to-one to the two ink stacks 5, and each of the ink absorption pad clean elements 6 is rotatably connected with the first sidewall 31 and the second sidewall 32.

When the work platform 4 is adjusted to descend to the first position, the four stoppers 41 on the two lateral surfaces 40 of the work platform 4 apply pressure to the ink absorption pad clean elements 6, and the stoppers 41 make each of the ink absorption pad clean elements 6 contact with the corresponding ink absorption pad 50 of the ink stack 5. When the work platform 4 is adjusted from the first position to the second position, one of the ink absorption pad clean elements 6 is rotated by gravity to contact with the third sidewall 33 of the housing 3, and the other ink absorption pad clean element 6 is rotated to contact with the forth sidewall 34 of the housing 3, so that the corresponding ink absorption pads 50 are cleaned through the rotating path. In some embodiments, the ink absorption pad clean elements 6 are line-symmetrical to each other, but not limited herein. The detailed structure of the ink absorption pad clean element 6 is described in detail above.

In some embodiments, the ink cartridge clean device 1 of the present invention includes two scrapers 8, and each of the scrapers 8 is disposed on the work platform 4. One of the scrapers 8 is disposed between one of the ink stacks 5 and the third sidewall 33, and the other scraper 8 is disposed between the other ink stack 5 and the fourth sidewall 34. When the work platform 4 is adjusted from the first position to the second position, the corresponding ink absorption cotton 62 of the ink absorption pad clean element 6 is cleaned by each scraper 8. That is to say, on the rotating path that the ink absorption pad clean elements 6 are rotated by gravity to naturally sway down, the residual ink on the absorption cottons 62 is scraped by the scrapers 8.

In some embodiments, the heights of the third sidewall 33 and the fourth sidewall 34 are lower than the first sidewall 31 and the second sidewall 32. Therefore, when the two ink absorption pad clean elements 6 are rotated by gravity to contact with the third sidewall 33 and the fourth sidewall 34, the main bodies 60 of the ink absorption pad clean elements 6 can be blocked and stopped stably at the first sidewall 31 and the second sidewall 32, but not limited herein.

From the above description, the present invention provides an ink cartridge clean device in order to solve the drawbacks of prior arts. By adjusting the work platform to rise or descend, the ink absorption pad clean element is contacted with the ink absorption pad or rotated to contact with the housing, thereby cleaning the corresponding ink absorption pad, so that the residual ink is prevented from contaminating or blocking the ink cartridge, and the printing quality is enhance. Furthermore, through applying pressure to the curved rods of the ink absorption pad clean element by the stoppers or making the stoppers raise relative to the curved rods, the main body of the ink absorption pad clean element is contacted with the ink absorption pad or rotated by gravity to contact with the housing, so that the ink absorption pad is cleaned. In addition, through disposing the scraper on the work platform, when the work platform is adjusted from the first position to the second position, the ink absorption pad clean element is rotated, and the ink absorption cotton of the ink absorption pad clean element is cleaned by the scraper. Therefore, the residual ink on the ink absorption cotton is scraped, so that the ink absorption pad can be more effectively cleaned by the ink absorption cotton.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An ink cartridge clean device applied to clean at least one ink cartridge, comprising:

a housing having a first sidewall and a second sidewall opposite to each other, wherein an accommodation groove is defined by the housing;

a work platform disposed in the accommodation groove and having two lateral surfaces opposite to each other, wherein one of the lateral surfaces is disposed adjacent to the first sidewall, the other lateral surface is disposed adjacent to the second sidewall, and each of the lateral surfaces has at least one stopper;

at least one ink stack disposed on the work platform, wherein the ink stack corresponds one-to-one to the ink cartridge, and the ink stack has an ink absorption pad; and at least one ink absorption pad clean element, wherein the ink absorption pad clean element is rotatably connected with the first sidewall and the second sidewall, wherein when the work platform is adjusted to a first position, the stoppers make the ink absorption pad clean element contact with the corresponding ink absorption pad, and when the work platform is adjusted from the first position to a second position, the ink absorption pad clean element is rotated to contact with the housing, so that the ink absorption pad is cleaned.

2. The ink cartridge clean device according to claim 1 further comprising a transmission mechanism connected with the work platform, thereby adjusting the work platform to descend to the first position or rise to the second position.

3. The ink cartridge clean device according to claim 1, wherein the ink absorption pad clean element has a main body and two curved rods, and the curved rods are respectively extended from two ends of the main body, wherein one of the curved rods is rotatably connected with the first sidewall, and the other curved rod is rotatably connected with the second sidewall.

4. The ink cartridge clean device according to claim 3, wherein when the work platform is adjusted to the first position, each of the stoppers applies pressure to one of the curved rods, so that the main body is contacted with the corresponding ink absorption pad.

5. The ink cartridge clean device according to claim 4, wherein when the work platform is adjusted from the first position to the second position, each of the stoppers is raised relative to the curved rod, so that the main body is contacted with the housing.

6. The ink cartridge clean device according to claim 5, wherein each of the curved rods has an extending part and a curving part, the extending part is extended from the main body, and the curving part is connected with the first sidewall or the second sidewall, wherein when the work platform is adjusted to the first position, each of the stoppers applies pressure to the curving part of one of the curved rods, and when the work platform is adjusted from the first position to the second position, each of the stoppers is raised relative to the curving part.

7. The ink cartridge clean device according to claim 3, wherein the main body of the ink absorption pad clean element further has an ink absorption cotton.

8. The ink cartridge clean device according to claim 7 further comprising at least one scraper, wherein the scraper is disposed on the work platform, and wherein when the work platform is adjusted from the first position to the second position, the ink absorption cotton is cleaned by the scraper.

9. An ink cartridge clean device applied to clean two ink cartridges, comprising:

a housing having a first sidewall, a second sidewall, a third sidewall and a forth sidewall, wherein the first sidewall is opposite to the second sidewall, and the first sidewall is adjacent to the third sidewall and the forth sidewall, and wherein an accommodation groove is defined by the housing;

a work platform disposed in the accommodation groove and having two lateral surfaces opposite to each other, wherein one of the lateral surfaces is disposed adjacent to the first sidewall, the other lateral surface is disposed adjacent to the second sidewall, and each of the lateral surfaces has two stoppers;

two ink stacks disposed on the work platform, wherein the ink stacks correspond one-to-one to the ink cartridges, and each of the ink stacks has an ink absorption pad; and two ink absorption pad clean elements, wherein each of the ink absorption pad clean elements is rotatably connected with the first sidewall and the second sidewall, wherein when the work platform is adjusted to a first position, the stoppers make each of the ink absorption pad clean elements contact with the corresponding ink absorption pad, and when the work platform is adjusted from the first position to a second position, one of the ink absorption pad clean elements is rotated to contact with the third sidewall, and the other ink absorption pad clean element is rotated to contact with the forth sidewall, so that the ink absorption pads are cleaned.

10. The ink cartridge clean device according to claim 9, wherein the ink absorption pad clean elements are line-symmetrical to each other.

* * * * *